US008479947B1

(12) United States Patent
Albrecht, II

(10) Patent No.: US 8,479,947 B1
(45) Date of Patent: Jul. 9, 2013

(54) DUAL COMPARTMENT COOLER

(76) Inventor: John A. Albrecht, II, Daleville, AL (US)

( * ) Notice: Subject to any disclaimer, the term of this patent is extended or adjusted under 35 U.S.C. 154(b) by 0 days.

(21) Appl. No.: 13/424,440

(22) Filed: Mar. 20, 2012

(51) Int. Cl.
*B65D 81/38* (2006.01)

(52) U.S. Cl.
USPC ..... 220/592.02; 220/524; 220/533; 220/536; 220/545

(58) Field of Classification Search
USPC ..... 220/592.2, 592.25, 592.26, 500, 220/523, 524, 529, 532, 533, 536, 541, 546, 220/542; 206/541, 545; 62/457.7
See application file for complete search history.

(56) References Cited

U.S. PATENT DOCUMENTS

| | | | | |
|---|---|---|---|---|
| 2,496,296 | A * | 2/1950 | Lobl | 62/457.6 |
| 2,498,125 | A * | 2/1950 | Knudsen et al. | 220/636 |
| 2,610,759 | A | 9/1952 | Slade | |
| 3,395,550 | A * | 8/1968 | Dungan | 62/457.7 |
| 3,791,547 | A * | 2/1974 | Branscum | 220/592.2 |
| 4,515,421 | A * | 5/1985 | Steffes | 62/457.7 |
| 4,759,467 | A | 7/1988 | Byrne | |
| 4,872,589 | A | 10/1989 | Englehart et al. | |
| 4,899,928 | A | 2/1990 | Korff | |
| 4,964,528 | A | 10/1990 | Wagoner | |
| 5,411,355 | A * | 5/1995 | Gosnell et al. | 220/542 |
| 6,024,241 | A | 2/2000 | Keillor | |
| 6,039,202 | A | 3/2000 | Olstad et al. | |
| 6,966,450 | B2 | 11/2005 | Askew | |
| 2003/0019873 | A1 * | 1/2003 | Nam et al. | 220/524 |
| 2003/0139169 | A1 * | 7/2003 | Arreazola, Jr. | 455/344 |
| 2004/0262319 | A1 * | 12/2004 | Fisher | 220/592.03 |

* cited by examiner

*Primary Examiner* — Andrew Perreault
(74) *Attorney, Agent, or Firm* — Montgomery Patent & Design; Robert C. Montgomery

(57) ABSTRACT

An insulated picnic cooler having thermally isolated internal compartments separated by a dividing wall. A removable and adjustable shelf assembly can divide an internal compartment into thermally isolated storage pockets. The shelf assembly is spring loaded to remain in place and flush mounting "T"-shaped handles can retract the springs to enable the shelf to be removed or adjusted. Hot and cold food items as well as ice and beverages can be stored. A drain can be used to drain liquids from a storage compartment.

18 Claims, 4 Drawing Sheets

DUAL COMPARTMENT COOLER

RELATED APPLICATIONS

There are currently no applications co-pending with the present application.

FIELD OF THE INVENTION

The presently disclosed subject matter is directed towards picnic coolers. More particularly, the present invention relates to picnic coolers having multiple thermally insulated compartments and storage compartments.

BACKGROUND OF THE INVENTION

Spending time in the outdoors is one of the most popular fair weather leisure time activities. Whether fishing, camping, picnicking, cooking out, tailgating, or just a simple party, a spending time outdoors is enjoyable. One (1) common way to increase that enjoyment is to bring along food and drink. In fact, a great deal of time is often spent preparing, packing, transporting, and consuming food and drink.

A very useful device for transporting food and drink is the picnic cooler. Prior art picnic coolers have proven to be very good at keeping beverages such as beer and soda cold by packing them in ice. Those prior art picnic coolers have proven to be less useful for keeping hot foods hot and for keeping other items such as paper products, bread, condiments, eating utensils, and the like separated and readily available for use. Such items are usually carried separately in another container or placed in the picnic cooler where they risk .becoming soggy or wet either by condensation or direct contact with melted ice.

The foregoing presents problems either because additional containers are required or contamination of food products or other items may occur. Accordingly, there exists a need for an improved picnic cooler that can keep cold items cold, hot items hot, that enables other items to be readily available, and that enables everything to be carried as a single unit.

SUMMARY OF THE INVENTION

The principles of the present invention provide picnic coolers that can keep cold items cold and hot items hot while enabling other items to be readily available and that enables everything to be carried as a single unit. Beneficially such picnic coolers would have two (2) main compartments, one to hold wet (iced) items and the other to hold dry (cold or hot) items. Preferably additional compartments could be formed if needed to retain small items such as paper products, bread, condiments, eating utensils and the like. Also beneficially such picnic coolers would have dimensions similar to or identical with existing picnic coolers (approximately fourteen inches (14 in.), thirty-six inches (36 in.) long, and fifteen inches (15 in.) deep).

A dual compartment cooler in accord with the principles of the present invention includes a substantially rectangular cooler assembly having a cooler body that is divided by an insulated interior dividing wall into a watertight first compartment with a first floor panel and a second compartment with a second floor panel. At least one (1) "U"-shaped carrying handle is attached to the cooler body. The second compartment can be selectively divided into a first partition and a second partition by an interior horizontal shelf assembly. The first compartment can be selectively covered by a first lid while the second compartment can be selectively covered by a second lid.

Beneficially, the second compartment includes a plurality of detents for retaining the horizontal shelf assembly within the second compartment. The horizontal shelf assembly can be released using a "T"-shaped release handle that controls at least two (2) pin features that selectively fit into detents. Preferably the pin features are on ends of a locking bar that is operatively connected to the "T"-shaped release handle. The locking bar and the "T"-shaped release handle are beneficially connected by a spring-loaded pivot connector. For convenience, "T"-shaped release handle fits into a recess in the horizontal shelf assembly.

A first hinge attaches the first lid to the cooler body. In practice, the first lid will have a molded-in lid handle. Both the cooler body and the first lid are beneficially comprised of hollow plastic filled with insulation. A fluid drain drains liquid from the first compartment through the cooler body and out of the dual compartment cooler. A tether-connected cap is included to selectively seal the fluid drain. Additionally, the first lid includes a lid sealing edge around its inner perimeter that mates with a compartment sealing edge around the top perimeter of the first compartment.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
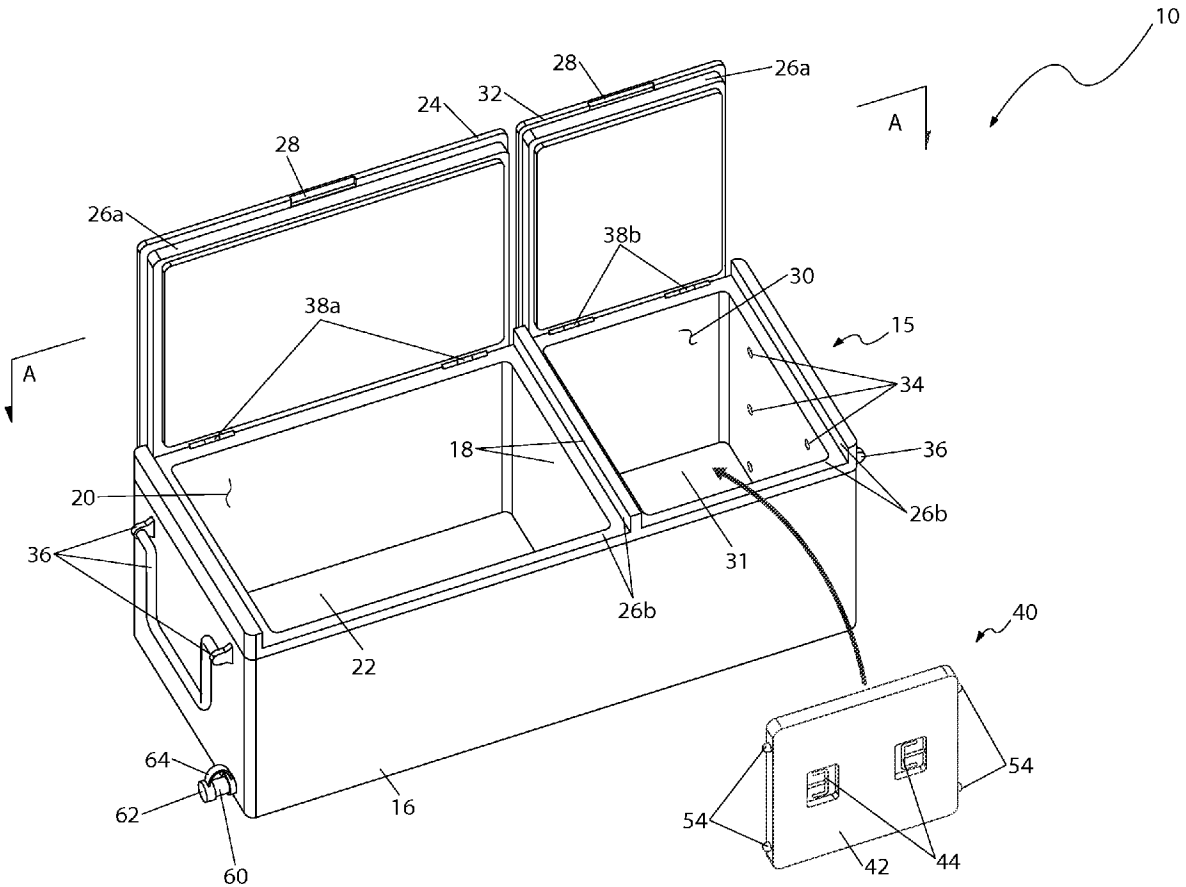
FIG. 1 is a front perspective view of a dual compartment cooler that is in accord with the principles of the present invention.

10 dual compartment cooler
15 cooler assembly
16 cooler body
18 dividing wall
20 wet compartment
22 first floor panel
24 first lid
26*a* lid sealing edge
26*b* compartment sealing edge
28 lid handle
30 dry compartment
31 second floor panel
32 second lid
34 detent
36 carrying handle
37 insulation
38*a* first hinge
38*b* second hinge
40 shelf assembly
42 shelf panel
44 release handle
46 recess

48 pivot connector
50 spring
52 locking bar
54 pin feature
60 fluid drain
62 cap
64 tether strap

DETAILED DESCRIPTION OF THE PREFERRED EMBODIMENT

The best mode for carrying out the invention is presented in terms of its preferred embodiment, herein depicted within FIGS. 1 through 4, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention are embodied in a dual compartment cooler 10 that is especially useful to campers, hunters, fishermen, and boaters, and at tailgate or beach parties. The dual compartment cooler 10 provides a means for transporting hot and/or cold foodstuffs as well as all types of items associated with a picnic.

Figure 2:
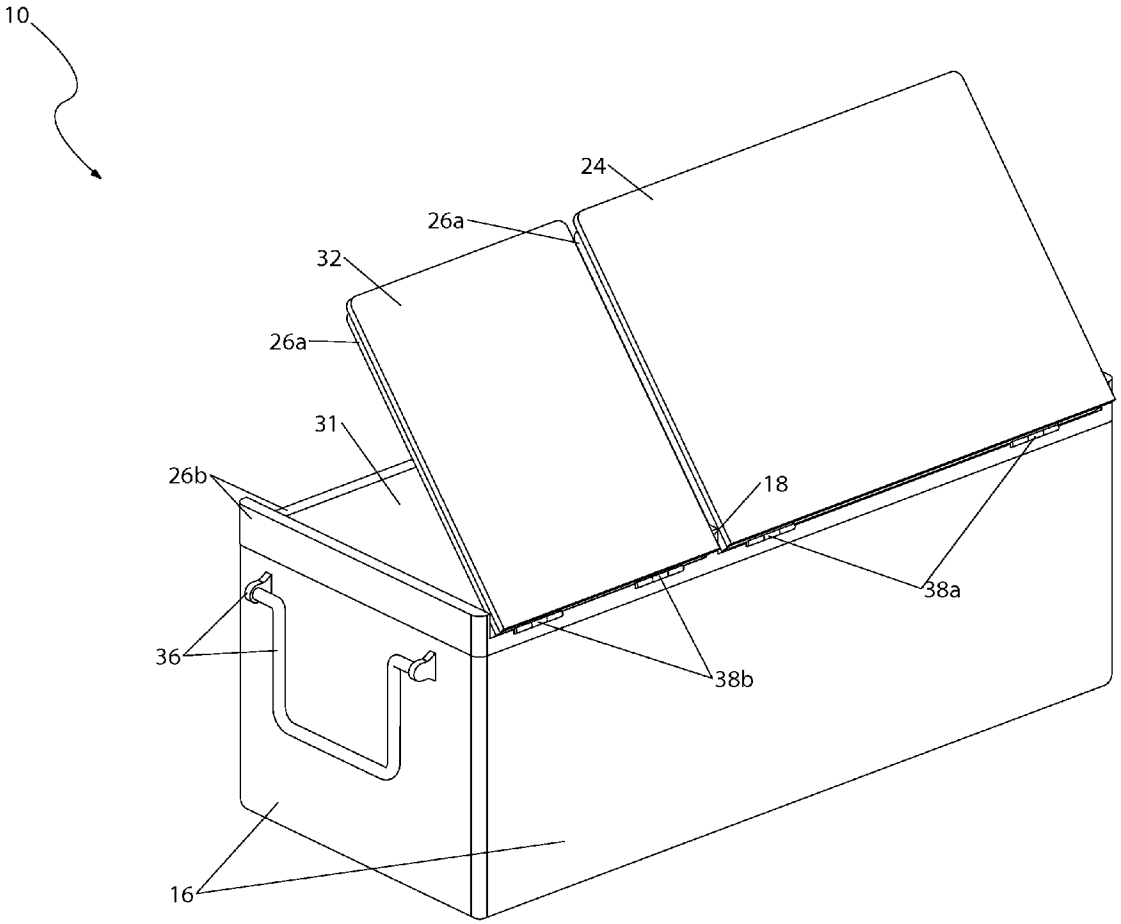
FIG. 2 is a rear perspective view of the dual compartment cooler illustrated in FIG. 1.

Referring now to FIGS. 1 and 2, respectively front and rear views of the dual compartment cooler 10, the dual compartment cooler 10 includes a cooler assembly 15 having two (2) compartments, a (first) wet compartment 20 (shown on the left side) and a (second) dry compartment 30 (shown on the right side). The compartments 20, 30 can be used to separate wet items, such as refrigerated foodstuffs and ice in the wet compartment 20 from dry items, which may be either hot or cold, in the dry compartment 30.

The outer shape of the dual compartment cooler 10 is preferably similar to that of a conventional rectangular picnic cooler. That shape is provided by a picnic cooler assembly 15 having a cooler body 16 that is about fourteen inches (14 in.) high, thirty-six inches (36 in.) long, and fifteen inches (15 in.) deep. The interior of the cooler body 16 is divided into a wet compartment 20 having a first floor panel 22 and a dry compartment 30 having a second floor panel 31 by a dividing wall 18. The interior of the cooler body 16 is configured such that the wet compartment 20 and the dry compartment 30 are watertight in that water cannot leak from the wet compartment 20 to the dry compartment 30. Furthermore, the cooler body 16 and the dividing wall 18 as insulated. Preferably the wet compartment 20 is approximately twenty-one inches (21 in.) wide while the dry compartment 30 is approximately fifteen inches (15 in.) wide (dimensions include the thickness of the cooler body 16). However, it should be understood that the dividing wall 18 may be located to provide different dimensioned compartments 20, 30.

The cooler body 16 further comprises a pair of pivoting "U"-shaped carrying handles 36 that are permanently affixed to opposing short sides of the cooler body 16 to enable easy transportation.

Typically the larger compartment, the wet compartment 20 will hold ice and beverages while the smaller compartment, the dry compartment 30 will hold either cold or hot foods such as potato salad, cooked meats, or the like, or associated picnic items such as paper products, condiments, eating utensils, and the like. However, the dry compartment 30 could be used to hold ice and beverages, thus the labels "wet" and "dry" are not limitations of use but are labels for convenience of explanation. In practice the dry compartment 30 will be provided with at least one (1) removable insulated interior horizontal shelf assembly 40 (best shown in FIG. 4). The shelf assembly 40 is useful for thermally isolating items as well as helping retain items in place.

Still referring to FIGS. 1 and 2, the picnic cooler assembly 15 further includes a first lid 24 and a second lid 32. The first lid 24 is used to selectively cover the wet compartment 20 while the second lid 32 is used to selectively cover the dry compartment 30. Referring now to FIG. 2, the first lid 24 is affixed along the rear top edge of the cooler body 16 via a first hinge 38*a* while the second lid 32 is affixed along the rear top edge of the cooler body 16 via a second hinge 38*b*. The first and second hinges 38*a*, 38*b* beneficially comprise in-line pairs of axial elements that can be molded into the cooler body 16 and the first and second lids 24, 32, or they may also be affixed using fasteners. Each lid 24, 32 includes a molded-in recessed lid handle 28 that is located mid-way along its front edge. Each lid 24, 32 also has a lid sealing edge 26*a* around its inner perimeter that mates to corresponding compartment sealing edge 26*b* along the top edge of each compartment 20, 30 and on the cooler body 16. The lid sealing edge 26*a* and the compartment sealing edge 26*b* beneficially comprise interlocking molded-in features that reduce thermal flow to and from the cooler body 16.

Figure 3:
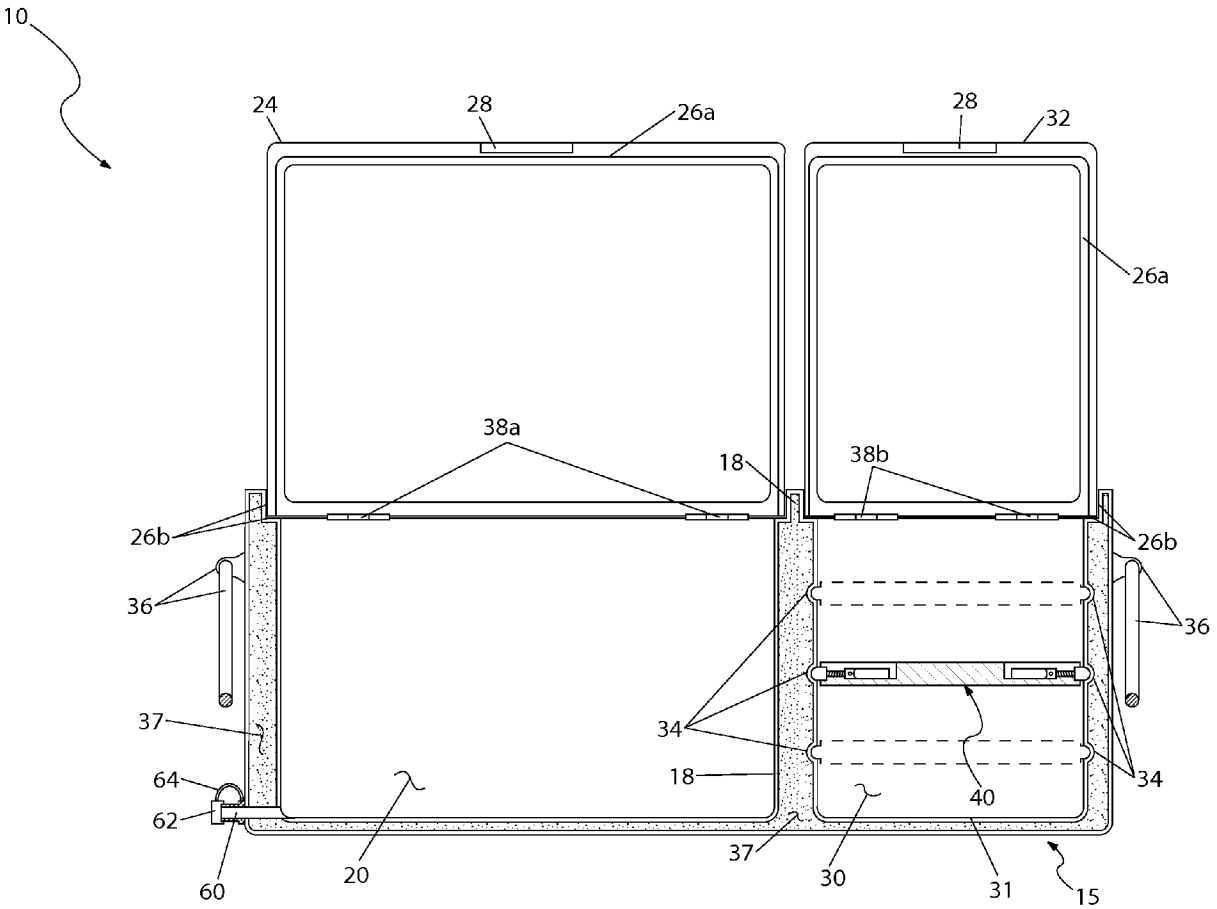
FIG. 3 is a section view of the dual compartment cooler shown in FIG. 1 and FIG. 2 taken along section line A-A of FIG. 1; and, FIG. 4 is a perspective view of a portable shelf assembly of the dual compartment cooler shown in FIGS. 1-3.

Referring now to FIG. 3, a section view of the dual compartment cooler 10 taken along line A-A of FIG. 1, the cooler body 16 and the lids 24, 32 are of a hollow plastic construction. They can be made using common manufacturing processes such as, but not limited to: blow-molding, compression-molding, injection-molding, rotational-molding, or the like. It is envisioned that the cooler body 16, the lids 24, 32, and the shelf assembly 40 (see FIG. 4) are made of a rugged plastic material such as, but not limited to: polyethylene, acrylonitrile butadiene styrene (ABS), or the like, and have any of a variety of attractive colors and patterns. It is envisioned that the inner volumes of the cooler body 16, the lids 24, 32, and the shelf assembly 40 are filled with insulation 37 such as polystyrene, fiberglass fibers, or the like.

Figure 4:
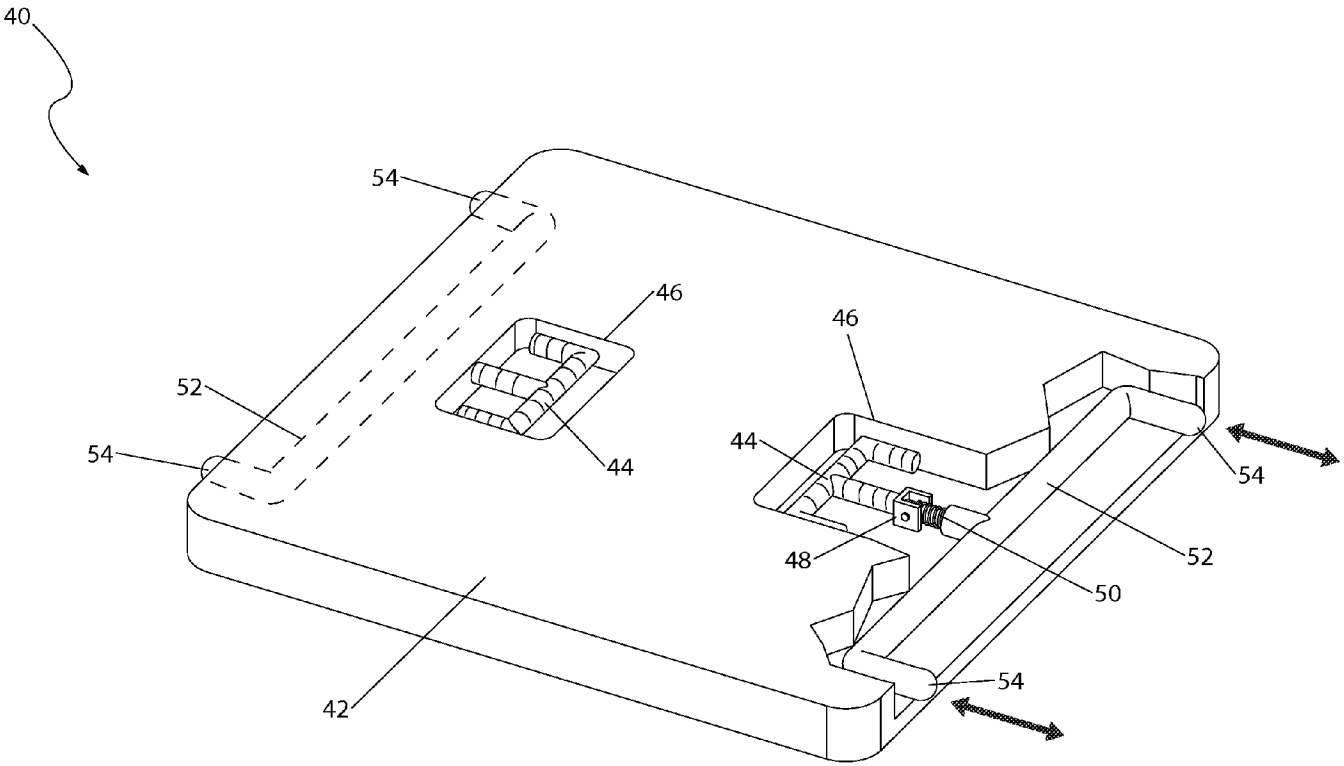

Referring now to FIG. 1, FIG. 3, and FIG. 4 the dry compartment 30 includes a plurality of positioned detents 34 that are used to attach and support the shelf assembly 40 within the dry compartment 30. The shelf assembly 40 engages with the detents 34 using (4) spring-loaded pin features 54 that can be manually extended or retracted by release handles 44 that are integrated into the shelf assembly 40 (FIG. 4). The detents 34 comprise integrally-molded ovular recessed areas that are approximately one-half (½) inch wide and one-quarter (¼) inch high and that are located upon opposing interior left-hand and right-hand sides of the dry compartment 30. The detents 34 are preferably arranged in equally-spaced vertical rows.

In use, the four (4) pin features 54 engage four (4) detents 34 being at a selected elevation. This secures the shelf assembly 40 in a horizontal position. Beneficially there are three (3) to six (6) rows of detents 34. Securing the shelf assembly 40 above the second floor panel 31 forms two (2) variable height partitions in the dry compartment 30. While the foregoing has described only a single shelf assembly 40, in practice a dual compartment cooler 10 might include multiple shelf assemblies 40 which can form thermally isolated partitions within the dry compartment 30.

Referring now again to FIG. 3, the picnic cooler assembly 15 further includes a fluid drain 60 that passes through the cooler body 16 and into the wet compartment 20. The fluid drain 60 is located just above the first floor panel 22 (see FIG. 1) and below a carrying handle 36. The fluid drain 60 comprises a tube which horizontally extends from inside the wet compartment 20 to provide a means to conveniently drain fluids within the wet compartment 20. Undesired drainage of fluids from the fluid drain 60 is prevented via a friction-fit or threaded plastic cap 62 that is affixed to the fluid drain 60 via an integrally-molded tether strap 64.

Referring now to FIG. 4, the shelf assembly 40 is dimensioned to fit snuggly between the vertical walls of the dry compartment 30. This minimizes thermal flow between pockets in the dry compartment 30 that are formed by the shelf assembly 40. The shelf assembly 40 comprises a hollow or solid plastic shelf panel 42 that is approximately one to two inches (1-2 in.) thick. As previously noted the four (4) pin features 54 of the shelf assembly 40 which provide secure attachment to the detents 34 are extended and retracted via "T"-shaped release handles 44. As shown in FIG. 4, the pin features 54 are the ends of two locking bars 52. Each release handle 44 includes an integrally-molded pivot connector 48 at an end of its "T", which in turn provides a connection to a compression spring 50. Each release handle 44 fits into an associated recess 46 at the top of the shelf assembly 40 and each is spring-loaded against an associated locking bar 52 by the spring 50. Each recess 46 is dimensioned to contain a release handle 44 flush with the top of the shelf assembly 40. The "T" shape of the release handles 44 enable a user to readily grasp and pull the release handle 44 out of its recess 46 and toward the center of the shelf assembly 40. This action causes the pin features 54 to retract. However, when a release handle is pushed back into its recess 46 the spring 50 outwardly biases the pin features 54.

It is envisioned that other styles and configurations of the present invention can be easily incorporated into the teachings of the present invention, and only one particular configuration is shown and described for purposes of clarity and disclosure and not by way of limitation of scope.

The preferred embodiment of the present invention can be utilized by the common user in a simple and effortless manner with little or no training. After initial purchase or acquisition of the dual compartment cooler 10, it would be used as indicated in FIG. 1. The method of using the dual compartment cooler 10 may be achieved by performing the following steps: procuring a model of the dual compartment cooler 10 having a desired overall size and color; opening the first lid 24 to expose the wet compartment 20; loading ice, beverages, refrigerated items, and the like, into the wet compartment 20; closing the first lid 24 onto the cooler body 16; opening the second lid 32; loading cold or hot foods and/or associated picnic items into the dry compartment 30; installing a shelf assembly 40 into the dry compartment 30 by grasping and pulling both release handles 44 upwardly and outwardly to retract the pin features 54; inserting the shelf assembly 40 downwardly into the dry compartment 30 to a desired elevation; inserting the release handles 44 into respective recesses 46 to engage the pin features 54 with corresponding detents 34; loading additional cold or hot foods and/or associated picnic items into the dry compartment 30 as needed; closing the second lid 32 onto the cooler body 16; utilizing the carrying handle 36 to transport the dual compartment cooler 10 to a desired location; using the dual compartment cooler 10 to store and supply contained items; removing and replacing the shelf assembly 40 as required to access items stored within the dry compartment 30; draining any water or liquid residue from the wet compartment 20 after use by removing the cap 62 from the fluid drain 60 and disposing of fluids; and, benefiting from convenient thermally-isolated storage of hot and cold food items as well as associated picnic items afforded a user of the dual compartment cooler 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A dual compartment cooler, comprising:

a substantially rectangular cooler assembly having a cooler body divided by an interior dividing wall into a first compartment with a first floor panel and a second compartment with a second floor panel, said second compartment having a plurality of detents;

at least one carrying handle attached to said cooler body;

an interior horizontal shelf assembly for partitioning the second compartment into a first partition and a second partition;

a first lid for selectively covering said first compartment;

a second lid for selectively cover said second compartment; and said interior horizontal shelf assembly comprising:

a first release handle comprising a first center member, a first horizontal member attached to a first end of said first center member and perpendicularly extending therefrom, and a first pair of vertical members located at each distal end of said first horizontal member perpendicularly extending away therefrom;

a first two pin features in mechanical communication with a second end of said first center member a second release handle comprising a second center member, a second horizontal member attached to a first end of said second center member and perpendicularly extending therefrom, and a second pair of vertical members located at each distal end of said second horizontal member perpendicularly extending away therefrom;

a second two in features in mechanical communication with a second end of said second center member;

wherein said first release handle controls said first two in features to selectively fit into a first two of said plurality of detents; and, wherein said second release handle controls said second two pins features said to selectively fit into a second two of said plurality of detents.

2. The dual compartment cooler according to claim 1, wherein said first two pin features are on ends of a locking bar operatively connected to said first release handle.

3. The dual compartment cooler according to claim 2, wherein said locking bar and said first release handle are connected by a pivot connector.

4. The dual compartment cooler according to claim 2, wherein said locking bar and said first release handle are connected by a spring.

5. The dual compartment cooler according to claim 1, wherein said first release handle and said second release handle fit into recesses in said horizontal shelf assembly.

6. The dual compartment cooler according to claim 1, further including a first hinge attaching said first lid to said cooler body.

7. The dual compartment cooler according to claim 1, wherein said first lid has a molded-in lid handle.

8. The dual compartment cooler according to claim 1, wherein said cooler body is comprised of hollow plastic.

9. The dual compartment cooler according to claim 8, wherein said first lid is comprised of hollow plastic.

10. The dual compartment cooler according to claim 9, wherein said first lid and said cooler body are filled with insulation.

11. The dual compartment cooler according to claim 10, further including a fluid drain for draining liquid from said first compartment through said cooler body.

12. The dual compartment cooler according to claim 11, further including a cap for selectively sealing said fluid drain.

13. The dual compartment cooler according to claim 12, further including a tether strap attaching said cap to said fluid drain.

14. The dual compartment cooler according to claim 1, wherein said first lid includes a lid sealing edge around its inner perimeter.

15. The dual compartment cooler according to claim 14, wherein said first compartment includes a compartment sealing edge around its top perimeter that mates with said lid sealing edge to form an insulating seal.

16. The dual compartment cooler according to claim 1, wherein said interior dividing wall is insulated.

17. The dual compartment cooler according to claim 1, wherein said interior dividing wall forms a watertight seal between said first compartment and said second compartment.

18. The dual compartment cooler according to claim 1, wherein said carrying handle is "U"-shaped.

* * * * *